US006241214B1

(12) United States Patent
Nisi et al.

(10) Patent No.: US 6,241,214 B1
(45) Date of Patent: Jun. 5, 2001

(54) STRUCTURE SUPPORTING APPARATUS

(75) Inventors: Yosio Nisi; Tadasu Matusima, both of Osaka (JP)

(73) Assignee: Elephant Chain Block Co., Ltd., Osaka (JP)

( * ) Notice: Subject to any disclaimer, the term of this patent is extended or adjusted under 35 U.S.C. 154(b) by 0 days.

(21) Appl. No.: 09/394,402

(22) Filed: Sep. 13, 1999

(30) Foreign Application Priority Data

Sep. 19, 1998 (JP) ..... 10-264243

(51) Int. Cl.[7] ..... B66F 1/00
(52) U.S. Cl. ..... 254/104
(58) Field of Search ..... 254/104, 103, 254/126

(56) References Cited

U.S. PATENT DOCUMENTS 3,244,401 * 4/1966 Ilmura ..... 254/103
4,559,986 * 12/1985 Svensson et al. ..... 254/104
5,781,830 * 7/1998 Gaylord et al. ..... 399/109

* cited by examiner

*Primary Examiner*—Robert C. Watson
(74) *Attorney, Agent, or Firm*—Dickstein Shapiro Morin & Oshinsky LLP

(57) ABSTRACT

To provide a structure supporting apparatus that enables an upper structure to be lifted up to a precise position with respect to a lower structure in a simple and reliable manner and also can be used as a supporting member as it is without fitting any stop members or equivalent, to provide improved workability. In a structure supporting apparatus in which an upper pressure-bearing member and a lower pressure-bearing member is moved relative to each other in the state of being laid one on another to vary the thickness of the upper pressure-bearing member and the lower pressure-bearing member in an overlaying direction, a driving device for driving the lower pressure-bearing member is so constructed that power input from a drive shaft can be transmitted to a feed screw through a reduction gear mechanism including intermediate gear elements.

5 Claims, 10 Drawing Sheets

STRUCTURE SUPPORTING APPARATUS

BACKGROUND OF THE INVENTION

1. Field of the Invention

The present invention relates to a structure supporting apparatus and, more specifically, to a structure supporting apparatus interposed between an upper structure and a lower structure of a structure, such as a bridge and an express-highway, comprising the upper structure and the lower structure for supporting the upper structure.

2. Description of Background Art

A structure composed of an upper structure 1 and a lower structure 2 for supporting the upper structure 1, such as, for example, a bridge and an express-highway, includes supporting members 3 which are interposed between the upper structure 1 and the lower structure 2, as shown in FIG. 1, to surely transmit vertical load of the upper structure 1 to the lower structure 2 or absorb expansion of the upper structure 1 resulting from temperature change or horizontal swinging motion of the same.

The supporting members 3 become fatigued for many years of use and thus must be replaced with new ones after a set period of time. For this, there has been proposed a supporting apparatus disclosed by, for example, Japanese Laid-open Patent Publication No. Hei 7(1995)-166514 and shown in FIGS. 10 to 12.

As shown in FIG. 10, the supporting apparatus comprises an upper pressure-bearing member 5 having at its bottom surface a lower sliding surface 4 of a slant surface, a lower pressure-bearing member 7 laid over the upper pressure-bearing member 5 and having at its top surface an upper sliding surface 6 of a slant surface which is slidable over the lower sliding surface 4 of the upper pressure-bearing member 5, and a hydraulic jack 8 for pulling the lower pressure-bearing member 7 to move it. In use, the supporting apparatus is first interposed between the upper structure 1 and the lower structure 2 in the state of the upper pressure-bearing member 5 and the lower pressure-bearing member 7 being displaced with each other in an axial direction. At that time, a tread 11 is interposed between the upper structure 1 and the upper pressure-bearing member 5 and also a base member 12 is interposed between the lower structure 2 and the lower pressure-bearing member 7. The upper pressure-bearing member 5, which has a projection 9 projecting from a bottom surface thereof, is laid so that the projection 9 can be inserted in a groove 10 formed in the upper pressure-bearing member 5. Further, a reaction bearing member 13 is interposed between the upper pressure-bearing member 5 and the hydraulic jack 8.

Subsequently, the hydraulic jack 8 is driven to pull the lower pressure-bearing member 7 toward the hydraulic jack 8, as shown in FIG. 11. The upper pressure-bearing member 5 is then pushed by the as-pulled lower pressure-bearing member 7, but is not moved, because the upper pressure-bearing member 5 is received by the reaction bearing member 13. Only the lower pressure-bearing member 7 is moved while the upper sliding surface 6 and the lower sliding surface 4 are in sliding engagement with each other. As a result of this, the thickness of the upper pressure-bearing member 5 and lower pressure-bearing member 7 in their overlaying direction becomes gradually increased. As a result of this, the supporting apparatus lifts up the upper structure 1 with respect to the lower structure 2, while supporting the upper structure 1 thereon.

Then, after the upper structure 1 is raised up to a suitable position with respect to the lower structure 2, stop members 14 are fitted into a space in the groove 10 in which the projection 9 is received, as shown in FIG. 12, to restrict relative movement between the upper pressure-bearing member 5 and the lower pressure-bearing member 7, so as to keep the upper structure 1 in the suitable position with respect to the lower structure 2.

This type of supporting apparatus enables the upper structure 1 to be lifted up in the state of being supported against the lower structure 2 and also can be used as the supporting member 3 as it is, thus having the advantage of permitting easy replacement of the supporting member 3, even in a case where there is no working room for removing the existing supporting member 3.

With this type of supporting apparatus, the upper structure 1 must be lifted up to a precise position with respect to the lower structure 2 and, accordingly, the lower pressure-bearing member 7 must be moved with accuracy. However, with the supporting apparatus disclosed by the JP Laid-Open Patent Publication No. Hei 7(1995)-166514 using the hydraulic jack 8 to move the lower pressure-bearing member 7, in the event that for example a hose of the hydraulic jack 8 is damaged and hydraulic pressure is decreased, there can be produced the disadvantages that the lower pressure-bearing member 7 can not be moved precisely and that the upper structure 1 as lifted is lowered. Further, since the hydraulic pressure in the hydraulic jack 8 decreases over a period of time, it is necessary that after the upper structure 1 is raised up to a suitable position with respect to the lower structure 2, the stop members 14 are fitted into the space in the groove 10 to restrict the relative movement between the upper pressure-bearing member 5 and the lower pressure-bearing member 7. Thus, the known supporting apparatus has the disadvantages of taking many processes and troublesome works.

On the other hand, for example when a gear transmission mechanism or equivalent is used instead of the hydraulic jack 8, the above-mentioned disadvantages caused by the decrease in hydraulic pressure may be avoided. But, since the gear transmission mechanism is, in general, not so high in the efficiency and also may cause the output power to vary with respect to the input power, it is hard to move the lower pressure-bearing member 7 with accuracy.

SUMMARY OF THE INVENTION

It is the object of the present invention to provide a structure supporting apparatus which is designed so that an upper structure can be lifted up to a precise position with respect to a lower structure in a simple and reliable manner and also can be used as a supporting member as it is without fitting any stop members or equivalent, to provide improved workability.

According to this invention, there is provided a structure supporting apparatus which comprises a first pressure-bearing member having a first sliding surface of a slant surface, a second pressure-bearing member laid on the first pressure-bearing member and having a second sliding surface of a slant surface slidably engaged with the first sliding surface, and a driving means for moving at least one of the first pressure-bearing member and the second pressure-bearing member and is so structured that the first sliding surface and the second sliding surface can be slid over each other by drive of the driving means, while the first pressure-bearing member and the second pressure-bearing member are moved relative to each other, whereby the thickness of the first pressure-bearing member and the second pressure-bearing member in an overlaying direction thereof can be varied, characterized in that the driving means includes an input shaft to which power from a power source is input, an output shaft mounted on the at least one of the first pressure-bearing member and the second pressure-bearing member, and a gear transmission mechanism that receives the power input from the input shaft to transmit it to the output shaft at a predetermined rotational ratio; that the gear transmission mechanism includes an input side gear provided on the input shaft, an output-side gear provided on the output shaft, and intermediate gear elements including intermediate gears engageable with at least the input-side gear and the output-side gear; and that the intermediate gear elements are provided between the input-side gear and the output-side gear.

With this construction, the power input from the input shaft is transmitted to the intermediate gears of the intermediate gear elements through the input-side gear and in turn the power transmitted to the intermediate gears is transmitted to the output shaft through the output-side gear. Then, the power transmitted to the output shaft drives at least one of the first pressure-bearing member and the second pressure-bearing member and thereby the first sliding surface and the second sliding surface are slid with each other, while the first pressure-bearing member and the second pressure-bearing member are moved relative to each other. As a result of this, the thickness of the first pressure-bearing member and the second pressure-bearing member in their overlaying direction varies.

According to this invention, since the power input from the input shaft is transmitted to the intermediate gears of the intermediate gear elements through the input-side gear and then is transmitted to the output shaft through the output-side gear, the input power can be output at a precise rotational ratio and with reliability. Hence, the first pressure-bearing member and/or the second pressure-bearing member on which the gear transmission mechanism is mounted can be moved with accuracy. Accordingly, for example, the upper structure can be lifted up to a precise position with respect to the lower structure.

With the gear transmission mechanism, damage that may be caused by using the hydraulic jack can be reduced, thus enabling the first pressure-bearing member and/or the second pressure-bearing member to be always moved with accuracy. Besides, for example, after the upper structure is raised up to a suitable position with respect to the lower structure, the inventive supporting apparatus can be used as the supporting member as it is without any stop members being fitted. Thus, improved workability can be produced.

According to this invention, it is preferable that the input shaft and the output shaft are aligned on the same axis.

With this construction, the power input from the input shaft is transmitted through the gear transmission mechanism to the output shaft arranged coaxially.

This construction that can bring the input shaft and the output shaft into axial alignment with each other can permit downsize of the gear transmission mechanism. Thus, improved capability of transmission and workability can be provided.

According to this invention, it is preferable that the intermediate gear elements are arranged in parallel around the axis on which the input shaft and the output shaft are aligned, and the intermediate gear elements are each composed of a first intermediate gear engageable with the input-side gear and a second intermediate gear engageable with the output-side gear, and the first intermediate gear and the second intermediate gear are aligned on the same axis in such a manner as to be non-rotatable thereto.

With this construction, the power input from the input shaft is transmitted through the input-side gear to the intermediate gear elements arranged in parallel around the axis on which the input shaft and the output shaft are aligned. In the intermediate gear elements, the power is transmitted to the first intermediate gears and second intermediate gears which are located on the concentric axes in such a manner as to be non-rotatable relative thereto. After that, the power is transmitted to the output shaft through the output-side gear.

With this construction, since the intermediate gear elements are so constructed that the first intermediate gears engageable with the input-side gear and the second intermediate gears engageable with the output-side gear are arranged on the concentric axes in such a manner as to be non-rotatable relative thereto and also the intermediate gear elements are arranged in parallel around the axis on which the input shaft and the output shaft are aligned, size reduction of the gear transmission mechanism can further be achieved and efficient power transmission can be achieved.

According to this invention, it is preferable that the intermediate gear elements include input-side gear elements located near the input shaft and arranged in parallel around the axis on which the input shift and the output shaft are aligned, a transfer gear element disposed between the input shaft and the output shaft and arranged on the axis on which the input shaft and the output shaft are aligned, and output-side gear elements located near the output shaft and arranged in parallel around the axis on which the input shaft and the output shaft are aligned; that the input-side gear elements include a first intermediate gear engageable with the input-side gear and a second intermediate gear engageable with the transfer gear element; that the transfer gear element includes a third intermediate gear engageable with the second intermediate gear and a fourth intermediate gear engageable with the output-side gear element; that the output-side gear elements include a fifth intermediate gear engageable with the fourth intermediate gear and a sixth intermediate gear engageable with the output-side gear; and that the first intermediate gear, the second intermediate gear, the fifth intermediate gear and the sixth intermediate gear are aligned on concentric axes; the first intermediate gear and the second intermediate gear are arranged in such a manner as to be non-rotatable relative to each other and the fifth intermediate gear and the sixth intermediate gear are arranged in such a manner as to be non-rotatable relative to each other.

With this construction, the power input from the input shaft is transmitted through the input-side gear to the input-side gear elements located near the input shaft and arranged in parallel. In the input-side gear elements, the power is transmitted to the first intermediate gears and the second intermediate gears which are arranged on concentric axes in such a manner as to be non-rotatable relative thereto. After that, the power is transmitted to the transfer gear element disposed between the input shaft and the output shaft. Then, the power is transmitted to the third intermediate gear and the fourth intermediate gear in the transfer gear elements and thereafter is transmitted to the output-side gear elements located near the output shaft and arranged in parallel. Then, the power is transmitted to the fifth intermediate gears and the sixth intermediate gears which are arranged on the concentric axes in such a manner as to be non-rotatable thereto in the output-side gear elements, respectively and thereafter is transmitted to the output shaft through the output-side gear.

With this construction, the intermediate gear elements are composed of the input-side gear elements, the transfer gear elements and output-side gear elements. In addition, the input-side gear elements are arranged near the input shaft and in parallel around the axis on which the input shaft and the output shaft are aligned and are composed of the first intermediate gears and the second intermediate gears arranged on the concentric axes in such a manner as to be non-rotatable relative thereto, and the output-side gear elements are arranged near the output shaft and in parallel around the axis on which the input shaft and the output shaft are aligned and are composed of the fifth intermediate gears and the sixth intermediate gears arranged on the concentric axes in such a manner as to be non-rotatable relative thereto. This construction can permit further size reduction of the gear transmission mechanism and also can achieve efficient power transmission. Besides, since the intermediate gear elements are structured to have more stages including the input-side gear elements, the transfer gear elements and the output-side gear elements, even when the torque of the input shaft is small, an increased output load can be output from the output shaft. Accordingly, for example, the upper structure can be lifted up to a precise position with respect to the lower structure readily and quickly by using a tool of small torque like an electric driver.

According to this invention, it is preferable that an overload protection mechanism is interposed in a transmission path of the gear transmission mechanism, for interrupting the transmission path when a load in excess of a rated load is applied.

With this construction, when a load in excess of a rated load is applied, the transmission path of the gear transmission mechanism is interrupted by the overload protection mechanism. Thus, damage of the apparatus due to the overload can be prevented and also can ensure the safety in working.

According to this invention, it is preferable that at least the components of the gear transmission mechanism consisting of the input-side gear, the output-side gear and gears included in the intermediate gear elements are coated with nickel-phosphorus plating.

With this nickel-phosphorus plating, part-to-part variations in coefficient of friction can be reduced. Thus, the power input from the input shaft can be transmitted to the output shaft with efficiency. Thus, the input power can be output at a more accurate rotational ratio and with further reliability.

According to this invention, it is preferable that fluorine components are mixed in the nickel-phosphorus plating, and a plating film in which fluorine components are eutectic dispersed in a matrix of nickel-phosphorus film is formed on the surfaces of the components.

The forming of the plating film in which fluorine components are eutectic dispersed in a matrix of nickel-phosphorus film can provide improvements of parts in wear resistance, sliding resistance and quiet. This can permit the power input from the input shaft to be transmitted to the output shaft with efficiency. Accordingly, the input power can be output at a more accurate rotational ratio and with further reliability.

DETAILED DESCRIPTION OF THE PREFERRED EMBODIMENTS

Figure 1:
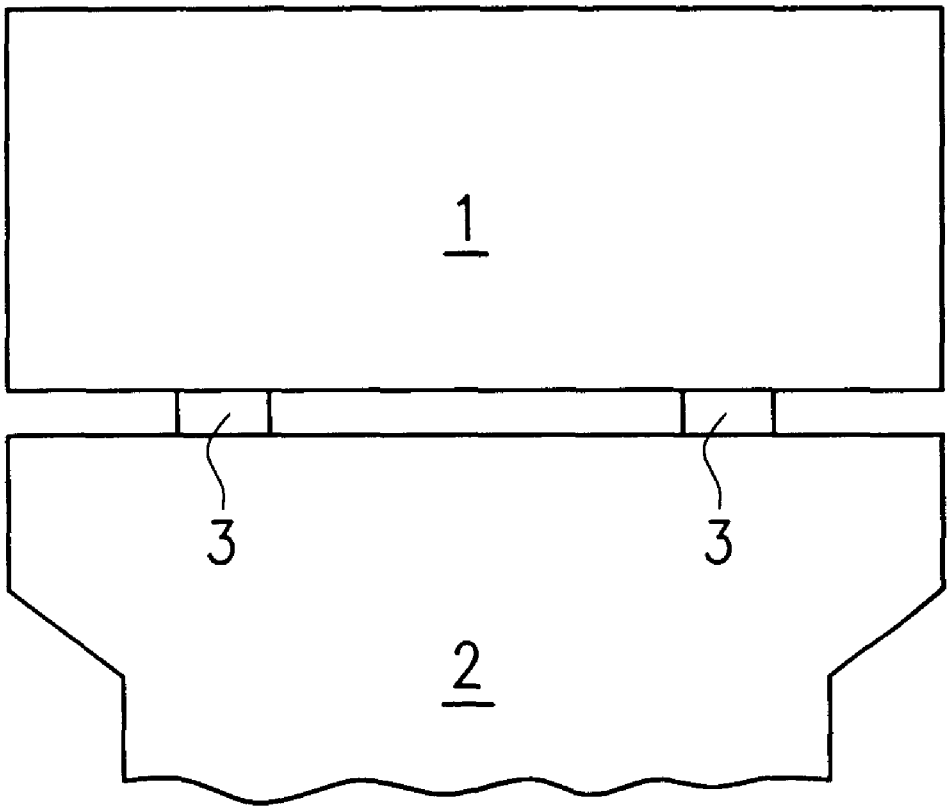
FIG. 1 is a front view showing an upper structure and a lower structure to which a supporting apparatus of one embodiment of the present invention is applied.
Figure 2:
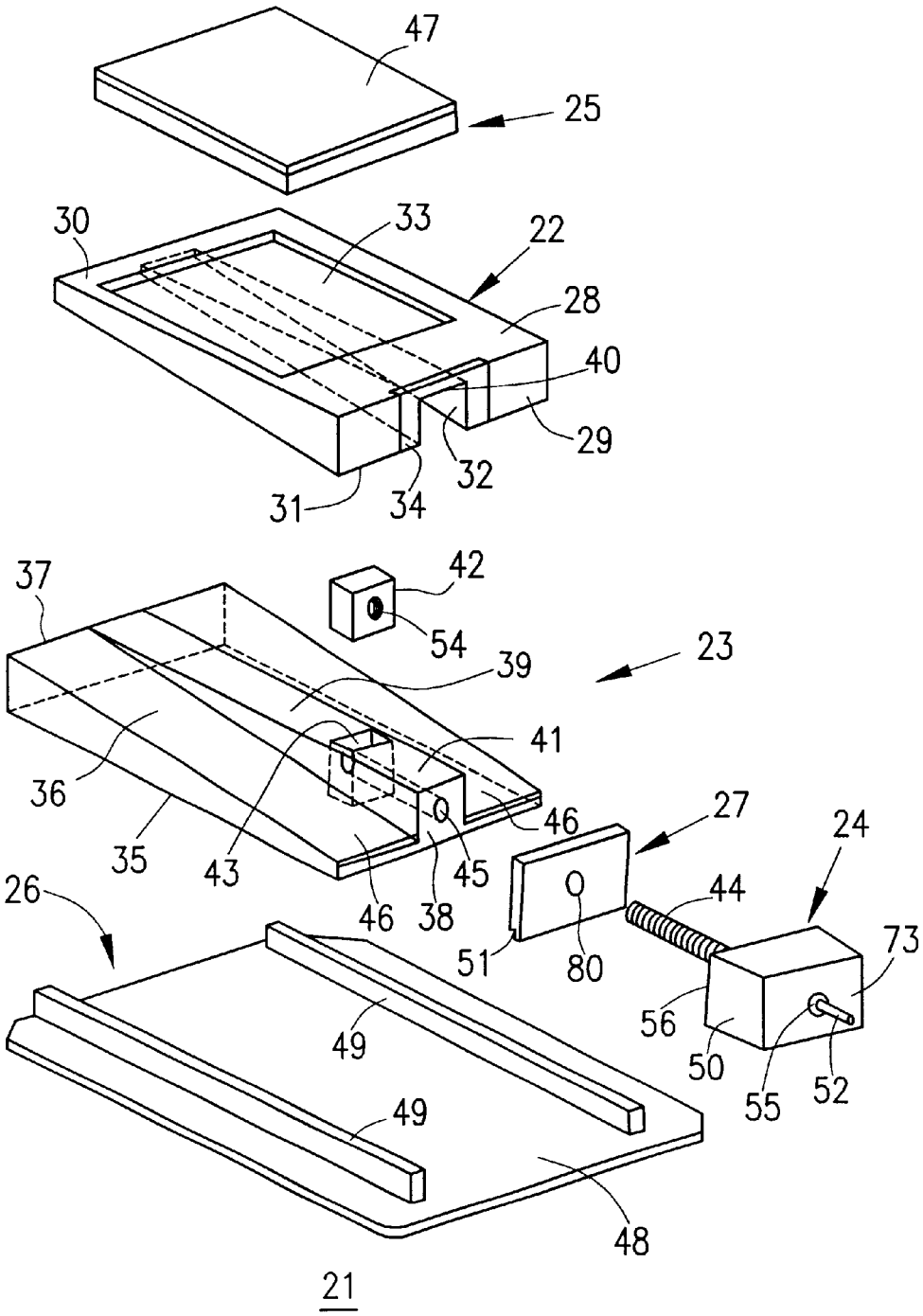
FIG. 2 is an exploded perspective view showing one embodiment of the supporting apparatus of the present invention.

FIG. 2 is an exploded perspective view showing one embodiment of the structure supporting apparatus of the present invention. In FIG. 2, the supporting apparatus 21 is used for replacing a supporting member 3 interposed between an upper structure 1 and a lower structure 2 for supporting the upper structure 1 of a structure, such as, for example, a bridge or an express-highway, with new one and is designed to be used as the supporting member 3 as it is, as shown in FIG. 1.

In FIG. 2, the supporting apparatus 21 is composed of an upper pressure-bearing member 22 as a first pressure-bearing member, a lower pressure-bearing member 23 as a second pressure-bearing member, a driving device 24 as a driving means for driving the lower pressure-bearing member 23, a tread 25, a base member 26 and a reaction bearing member 27.

The upper pressure-bearing member 22, which is made of lightweight and hard synthetic resin material and is rectangular in plan configuration, is formed into a generally wedge-like plate form in side configuration, having a horizontally extending top surface 28 and a bottom surface 31 obliquely extending along its lengthwise direction so that a front side surface 29 is made larger in thickness than a rear side surface 30. The bottom surface 31 of the slant surface operates as the first sliding surface. A U-like groove 32 extending from side to side along its longitudinal direction and opening downward is formed in a center of the upper pressure-bearing member 22 in a direction perpendicular to its lengthwise direction or in a widthwise direction. The groove 32 is so formed that a top surface 40 of the groove 32 can be made parallel with the top surface 28 of the upper pressure-bearing member 22 so that the interval between the top surface 40 and the top surface 28 of the upper pressure-bearing member 22 can be kept unchanged along the entire length. A recessed portion 33, rectangular in plan configuration, for the tread 25 to be fitted therein, is formed in the top surface 28 of the upper pressure-bearing member 22. To be more specific, the upper pressure-bearing member 22 is formed of laminate material of special fibers impregnated with phenol resin, and a U-like bearing plate 34, made of iron and steel material, for bearing thereon the reaction bearing member 27, is fitted in the front side surface 29 so as to be flush therewith.

The lower pressure-bearing member 23, which is made of lightweight and hard synthetic resin material, as in the case with the upper pressure-bearing member 22, and is rectangular in plan configuration, is formed into a generally wedge-like plate form in side configuration, having a horizontally extending bottom surface 35 and a top surface 36 obliquely extending along its lengthwise direction so that a rear side surface 37 is made larger in thickness than a front side surface 38. The top surface 36 of the slant surface operates as the second sliding surface. The slanting angle of the top surface 36 is made substantially equal to the slanting angle of the bottom surface 31 of the upper pressure-bearing member 22. A strip projection 39, extending from side to side along its longitudinal direction and projecting upwards, is integrally formed in a center part of the lower pressure-bearing member 23 in a direction perpendicular to its lengthwise direction or in a widthwise direction. The strip projection 39 is of rectangular in section to fit in the groove 32 of the upper pressure-bearing member 22 and is so formed that a top surface 41 of the strip projection 39 (which is indicated by a different reference numeral in FIG. 2 in order to discriminate between the top surface 36 of the lower pressure-bearing member 23 and the top surface 41 of the strip projection 39) can be made parallel with the bottom surface 35 of the lower pressure-bearing member 23 so that the height between the bottom surface 35 and the top surface 41 can be kept unchanged along the entire length. A fitting hole 43 of an angled tube-like form for fitting therein a retaining member 42 of the driving device 24 as discussed later is formed in the strip projection 39 at a lengthwise midpoint thereof so that the top surface 41 can be opened. An insertion hole 45 for a feed screw 44 serving as an output shaft of the driving device 24 as discussed later to pass therethrough is bored between a center part of the front side surface 38 of the strip projection 39 and the fitting hole 43 along a lengthwise direction of the strip projection 39. To be more specific, the lower pressure-bearing member 23 is formed of laminate material of special fibers impregnated with phenol resin, as is the case with the upper pressure-bearing member 22, and a bearing plate 46, made of iron and steel material, for bearing thereon the bottom surface 31 of the upper pressure-bearing member 22 in a slidable manner, is provided on the surface 36 of the lower pressure-bearing member 23 on both sides thereof facing across the strip projection 39.

The tread 25 is made of hard rubber material and is rectangular in plan configuration which is fittable in the recessed portion 33 formed in the top surface 28 of the upper pressure-bearing member 22. A bearing plate 47, made of iron and steel material, for bearing thereon the upper structure 1, is fitted in the top surface of the tread 25.

The driving device 24 is provided with a drive shaft 52 serving as an input shaft to which the power from a power source is input; the retaining member 42 fitted in the fitting hole 43 formed in the strip projection 39 of the lower pressure-bearing member 23; the feed screw 44 threadedly engaged on the retaining member 42 and serving as an output shaft; and a reduction gear mechanism 53 housed in a gear box 50 and serving as a gear transmission mechanism for receiving the power input from the drive shaft 52 and transmitting the input power to the feed screw 44 at a predetermined rotational ratio. The retaining member 42 is made of iron and steel material and is formed into a prismatic form fittable into the fitting hole 43, and a threaded hole 54 is formed in a center part of the retaining member to extend therethrough in the thickness direction from the front.

Figure 3:
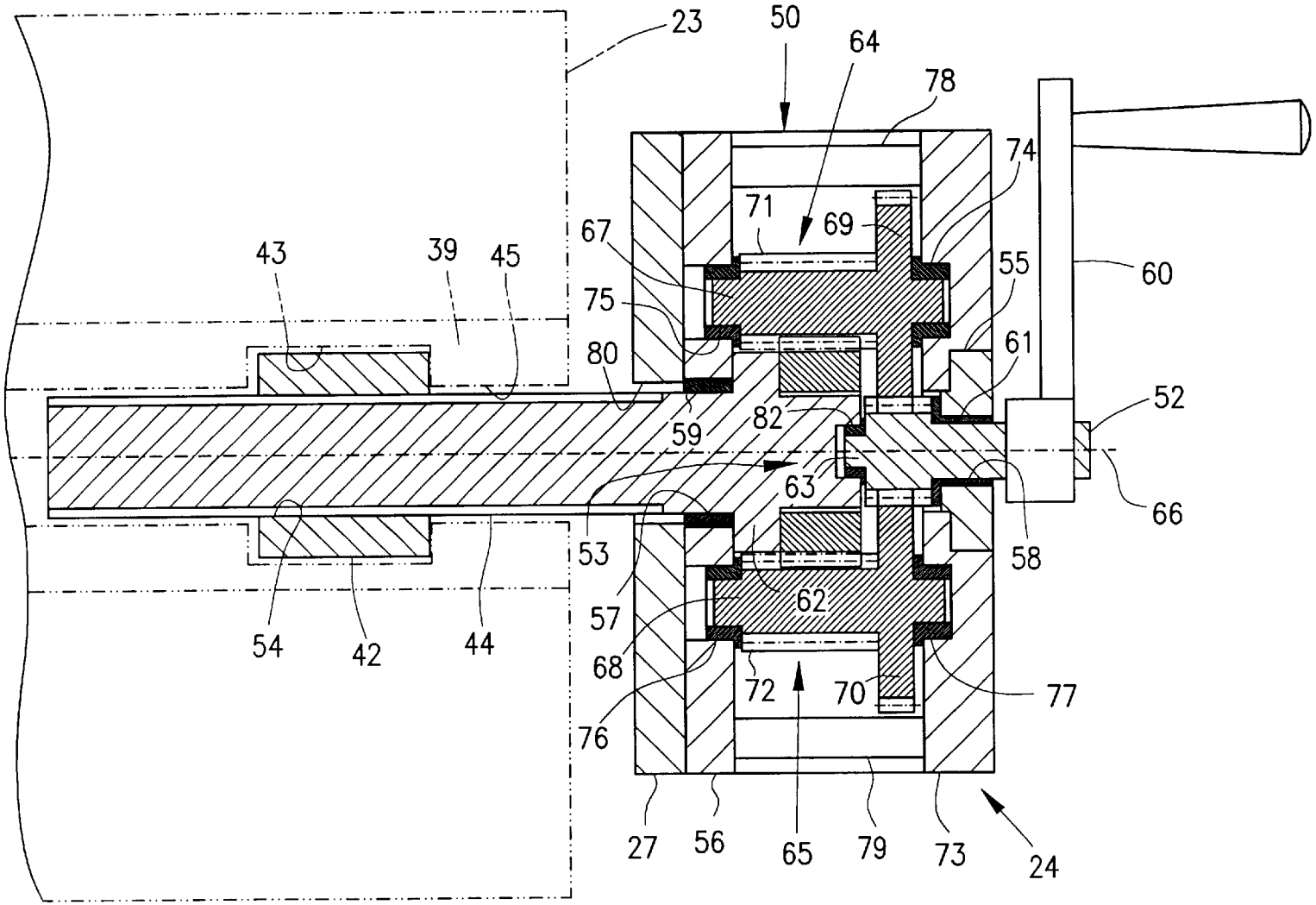
FIG. 3 is an upper sectional view showing an inside structure of a driving device of the supporting apparatus of FIG. 2.

The gear box 50 is a rectangular box made of iron and steel material and has, at a center part of the front wall 73, an aperture opening to permit the drive shaft 52 to pass through, as shown in FIG. 3. Provided in the aperture is a ring-like drive shaft supporting member 55 having a front insertion hole 58 for the drive shaft 52 to be passed through and supported therein. The gear box 50 has, at a center part of the rear wall 56, a rear insertion hole 57 for the feed screw 44 to pass through. The front insertion hole 58 in the drive shaft supporting member 55 and the rear insertion hole 57 in the rear wall 56 are so formed as to be aligned with each other on the same axis. The gear box 50 is supported by four stay bolts 78, 79 (only two stay bolts are shown in FIG. 3) connecting between the front wall 73 and the rear wall 56.

As shown in FIG. 3, the feed screw 44 is threadedly engaged in the threaded hole 54 in the retaining member 42 fitted in the fitting hole 43 at one end portion thereof and is supported at the other end portion thereof in the rear wall 56 of the gear box 50 in a rotatable manner via a bearing metal 59, passing through the rear insertion hole 57. On the other hand, the drive shaft 52 mounts a handle 60 on one end portion thereof in a detachable manner and is supported at the other end portion thereof by the drive shaft supporting member 55 in a rotatable manner via a bearing metal 61, passing through the front insertion hole 58. Also, the drive shaft 52 has an end portion which has a smaller diameter than the feed screw 44 and is received in a recess formed in an end portion of the feed screw 44 in a rotatable manner via a bearing metal 82. Thus, the drive shaft 52 is brought into alignment with the feed screw 44 on the same axis. The axis is indicated by reference numeral 66 in FIG. 3.

The reduction gear mechanism 53 is composed of an input-side gear 63, an output-side gear 62 and two intermediate gear elements 64, 65. The input-side gear 63 is formed at the end portion of the drive shaft 52 extending through the front insertion hole 58, so as to be integral with the drive shaft 52, in such a manner that the center of rotation can be formed by the axis of the drive shaft 52. The output-side gear 62 is splined to the end portion of the feed screw 44 passing through the rear insertion hole 57 in such a manner that the center of rotation can be formed by the axis of the feed screw 44. The two intermediate gear elements 64, 65 are arranged in parallel with an axis 66 on which the drive shaft 52 and the feed screw 44 are aligned, with being shifted to each other at 180 degree across the axis 66. In other words, the reduction gear mechanism 53 is composed of two gear shafts 67, 68 arranged in parallel about the axis 66; and the first intermediate gears 69, 70 and the second intermediate gears 71, 72 which are formed on the two gear shafts 67, 68, respectively.

The two gear shafts 67, 68 are rotatably supported by the front wall 73 and the rear wall 56 of the gear box 50 via bearing metals 74, 75 and 76, 77, respectively. The first intermediate gears 69, 70 are integrally formed on one side end portion of the gear shafts 67, 68 so that the centers of rotation can be formed by the axes of the gear shafts 67, 68 and are so arranged as to be engaged with the input-side gear 63. The second intermediate gears 71, 72, which are disposed adjoining to the first intermediate gears 69, 70 in the axial direction of the gear shafts 67, 68, are integrally formed on the gear shafts 67, 68 so that the centers of rotation can be formed by the axes of the gear shafts 67, 68 and are so arranged as to be engaged with the output-side gear 62. Thus, the first intermediate gears 69, 70 and the second intermediate gears 71, 72 are housed in the gear box 50 such as to be axially aligned with and non-rotatable relative to each other.

As shown in FIG. 2, the base member 26 is made of iron and steel material and is formed into a rectangular plate-like form in plan configuration so that the lower pressure-bearing member 23 can be born on the top surface 48 in a slidable manner. The base member 26 is provided, on its top surface 48, with guide portions 49 projecting therefrom for guiding the lower pressure-bearing member 23 to be moved in the axial direction of the lower pressure-bearing member 23 only. The guide portions 49 are composed of a pair of strip projections extending in parallel in the longitudinal direction of the base member 26 and are arranged at positions corresponding to both widthwise ends of the lower pressure-bearing member 23.

The reaction bearing member 27 is a member for bearing thereon the upper pressure-bearing member 22 pulled toward the driving device 24 by the drive of the driving device 24 and applying the reaction force to the upper pressure-bearing member 22 so as to permit the slide between the upper pressure-bearing member 22 and the lower pressure-bearing member 23. The reaction bearing member 27 is made of iron and steel material and is formed in rectangular form in plan configuration so that it can be interposed between the bearing plate 34 in the front side surface 29 of the upper pressure-bearing member 22 and the gear box 50 of the driving device 24. The reaction bearing member 27 has an insertion hole 80 formed at the center portion and a stepped portion 51 formed in the rear side surface at a lower end portion thereof so as to be engaged with the end of the base member 26.

Figure 5:
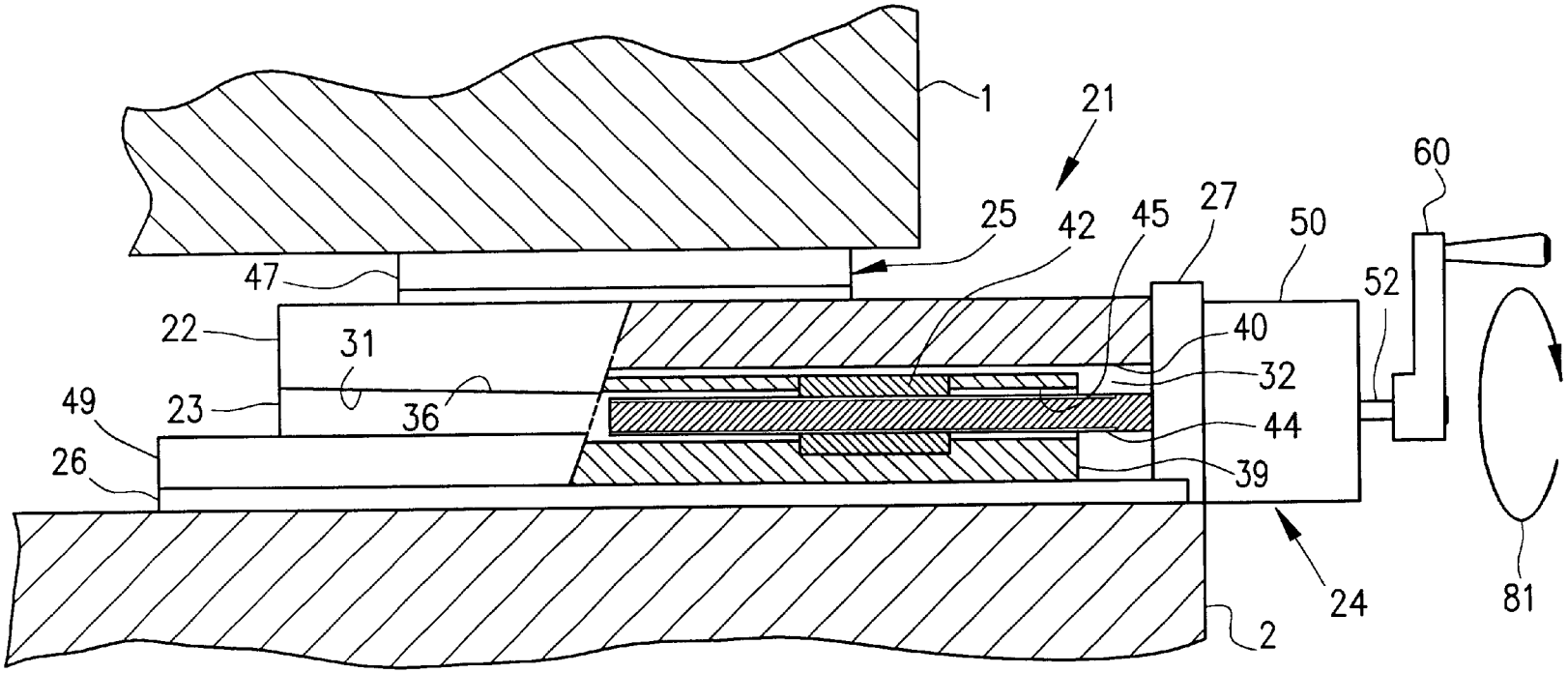
FIG. 5 is a side elevation view including a partly sectioned view of the supporting apparatus of FIG. 2 which is in the state of use.
Figure 6:
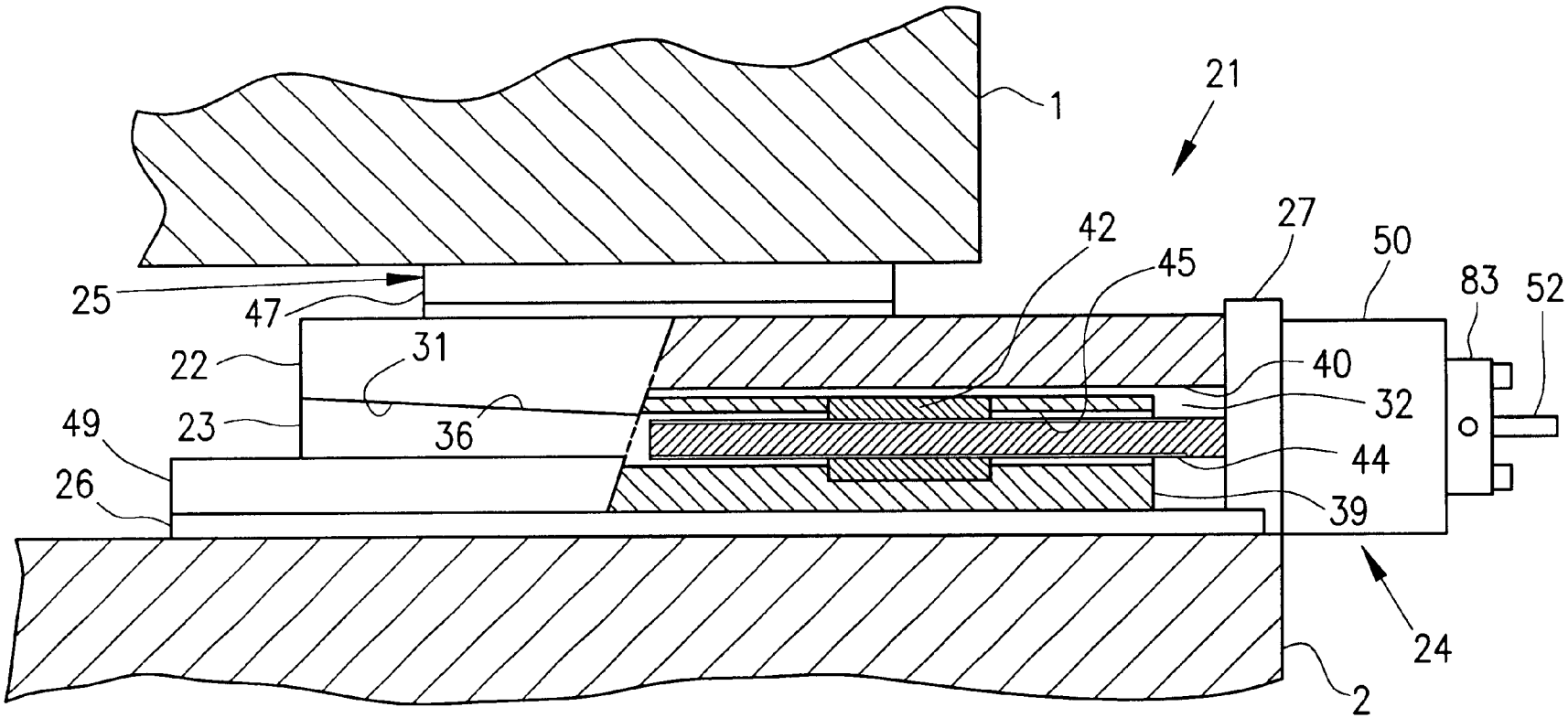
FIG. 6 is a side elevation view including a partly sectioned view of the supporting apparatus of FIG. 2 which is in the state of use.

Next, the usage of the illustrated supporting apparatus 21 thus constructed will be described with reference to FIGS. 4 through 6.

Figure 4:
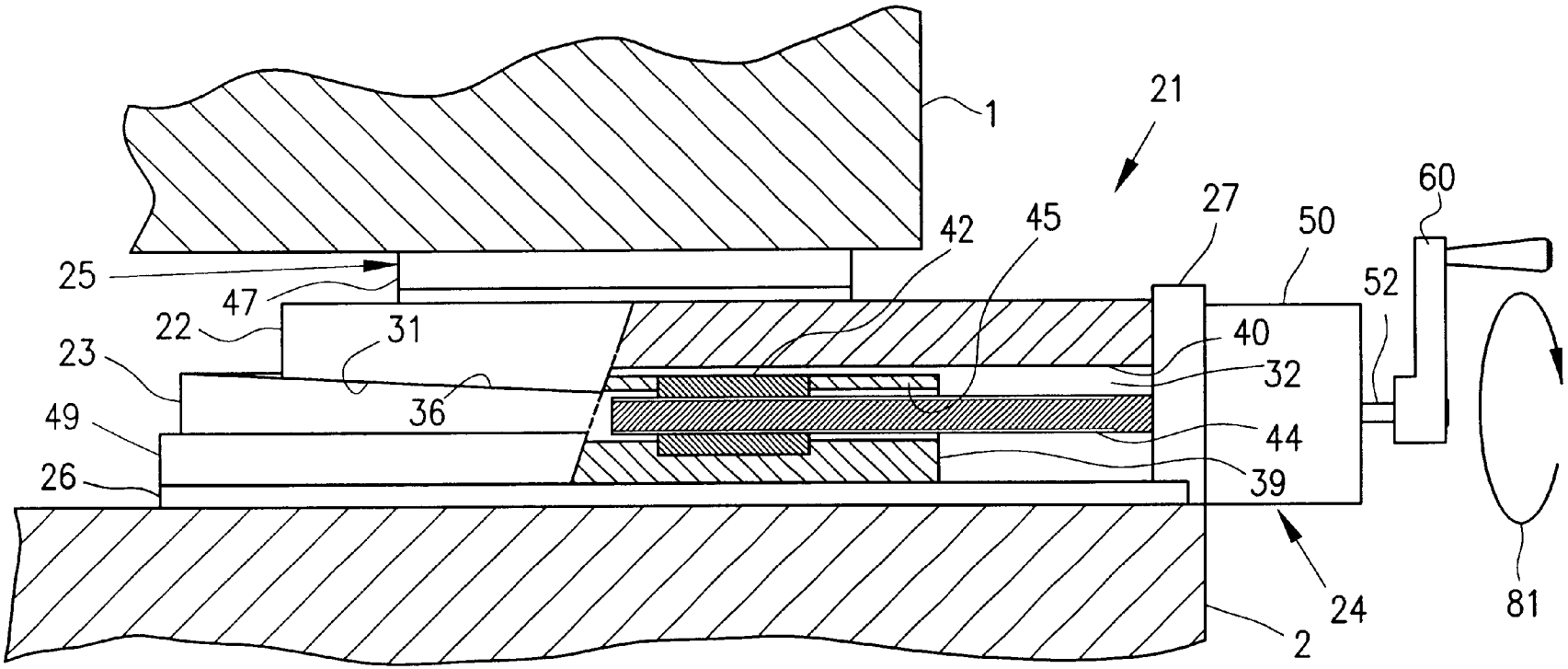
FIG. 4 is a side elevation view including a partly sectioned view of the supporting apparatus of FIG. 2 which is in the state of use.

FIG. 4 shows the state of the supporting apparatus 21 being set between the upper structure 1 and the lower structure 2. The setting of the supporting apparatus 21 is performed by the following steps. First, the base member 26 is fixed to the lower structure 2 by use of bolts or equivalent, for example. If the base member 26 is failed to be placed in a horizontal position, the base member 26 must be level before the fixing by interposing suitable plates or equivalent therewith. Then, the lower pressure-bearing member 23 is put on the top surface 48 of the base member 26 within the range of the guide portions 49. The retaining member 42 is fitted in the fitting hole 43 formed in the strip projection 39 of the lower pressure-bearing member 23 across the mount of the lower pressure-bearing member 23. Then, after having been passed through the insertion hole 80 in the reaction bearing member 27, one end portion of the feed screw 44 is passed through the insertion hole 45 formed in the strip projection 39 of the lower pressure-bearing member 23, to be threadedly secured into the threaded hole 54. Thus, the driving device 24 is fixedly mounted on the lower pressure-bearing member 23. Then, the upper pressure-bearing member 22 is laid on the lower pressure-bearing member 23 in such a manner that the groove 32 of the upper pressure-bearing member 22 is fitted with the strip projection 39 of the lower pressure-bearing member 23. The fit of the groove 32 with the strip projection 39 enables the upper pressure-bearing member 22 to slide over the lower pressure-bearing member 23 only in the direction of the strip projection 39 extending longitudinally. This brings the bottom surface 31 of the upper pressure-bearing member 22 and the top surface 36 of the lower pressure-bearing member 23 into sliding contact with each other. Then, the tread 25 is received with a press-fit into the recessed portion 33 formed in the top surface 28 of the upper pressure-bearing member 22 and thereby the setting of the supporting apparatus 21 is completed. The steps of a series of works for the setting do not matter. For example, all parts may be assembled together in advance to enable the setting at a stroke. In the setting, the upper pressure-bearing member 22 and the lower pressure-bearing member 23 are overlaid with being shifted to each other in the sliding direction in such a manner that a small gap is defined between the upper structure 1 and the tread 25 or the upper structure 1 and the tread 25 are brought into contact without being pressed with each other.

Then, the handle 60 is mounted on the drive shaft 52 and is turned clockwise (in the direction indicated by an arrow 81) with human power as a power source. The power input from the drive shaft 52 is transmitted through the input-side gear 63 to the two intermediate gear elements 64, 65 arranged in parallel around the axis 66 on which the drive shaft 52 and the feed screw 44 are aligned. In the intermediate gear elements 64, 65, the power is transmitted to the second intermediate gears 71, 72 from the first intermediate gears 69, 70 which are located on the axes of the gear shafts 67, 68 in such a manner as to be non-rotatable relative thereto. After that, the power is transmitted from the intermediate gear elements 64, 65 to the feed screw 44 through the output-side gear 62.

When the power is transmitted to the feed screw 44 at a predetermined rotational ratio through the drive shaft 52 and the reduction gear mechanism 53 by the turning of the handle 60, the retaining member 42 threadedly engaged with the feed screw 44 is screwed forward. As a result of this, the lower pressure-bearing member 23 is pulled toward the driving device 24. When the lower pressure-bearing member 23 is thus moved, the upper pressure-bearing member 22 is pushed by the lower pressure-bearing member 23 but is not moved because it is born by the reaction bearing member 27. As a result of this, while the upper pressure-bearing member 22 and the lower pressure-bearing member 23 are moved relatively to each other, the bottom surface 31 of the upper pressure-bearing member 22 and the top surface 36 of the lower pressure-bearing member 23 are slid over each other. As this relative movement occurs, the thickness of the upper pressure-bearing member 22 and lower pressure-bearing member 23 in their overlaying direction becomes gradually increased. This produces the result that the supporting apparatus 21 supports the upper structure 1 with respect to the lower structure 2, while lifting up the upper structure 1. Thus, when the turning of the handle 60 is stopped after the upper structure 1 is raised up to a suitable position with respect to the lower structure 2, as shown in FIG. 5, the relative movement between the upper pressure-bearing member 22 and the lower pressure-bearing member 23 is restricted and thereby the upper structure 1 is kept in the suitable position with respect to the lower structure 2.

Accordingly, the supporting apparatus 21 thus constructed can supports the upper structure 1 with respect to the lower structure 2, while lifting up the upper structure 1 and can be used as the supporting member 3 as it is. This can permit easy replacement of the supporting member 3, even in a case where there is no working room for removing the existing supporting member 3. It is to be noted that after the upper structure 1 is supported in the suitable position with respect to the lower structure 2, the handle 60 may be removed and for example a rotation regulating member 83 for regulating the rotation of the drive shaft 52 may be mounted on the drive shaft 52, as shown in FIG. 6, when necessary.

Figure 7:
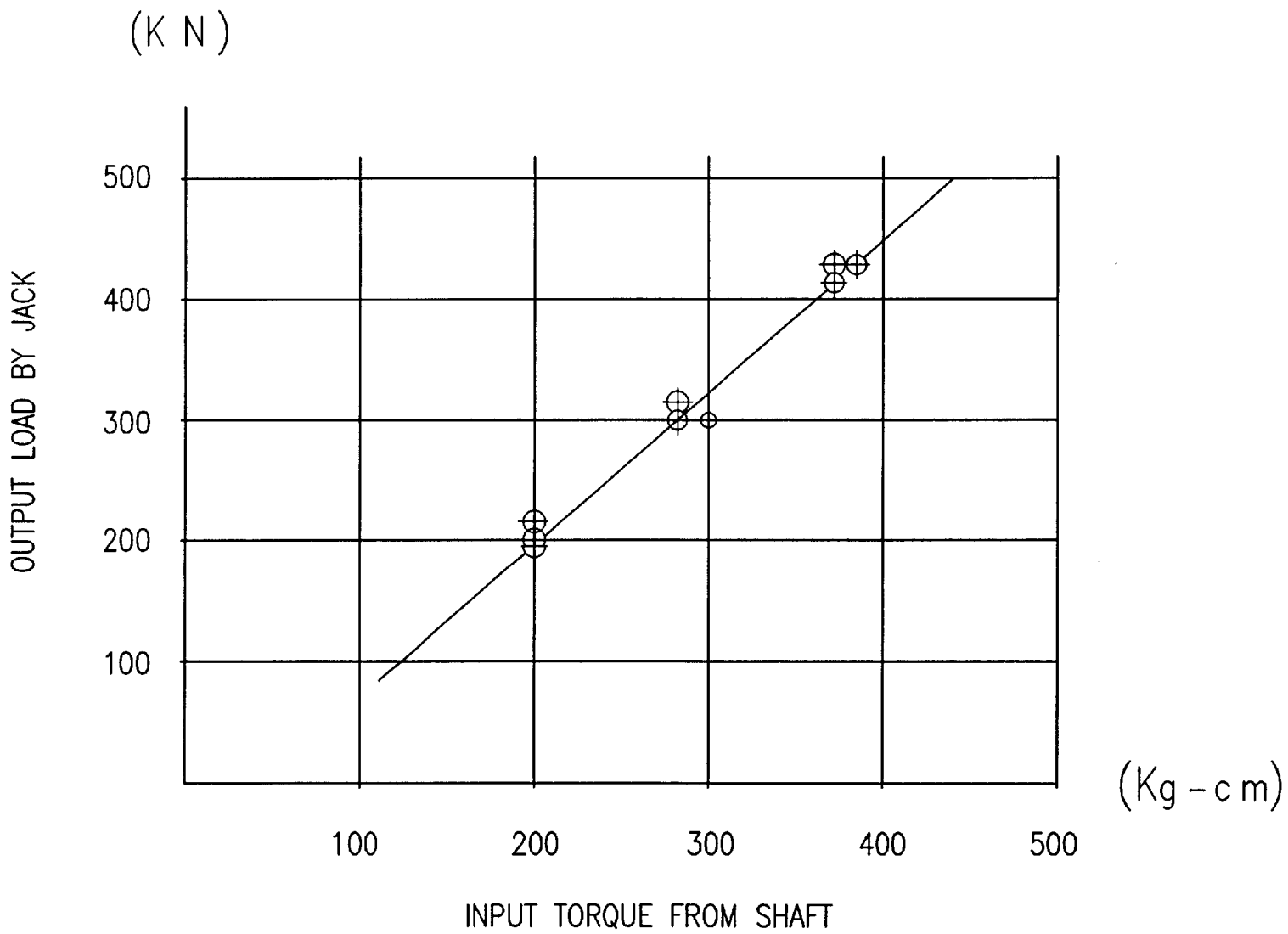
FIG. 7 is a diagram showing a characteristic of "Input Torque From Shaft—Output Load By Jack" of the driving device of the supporting apparatus of FIG. 2.

According to the supporting apparatus 21 of the illustrated embodied form, since the power input from the single drive shaft 52 is transmitted to the two intermediate gear elements 69, 70 through the input-side gear 63 and is in turn transmitted to the single feed screw 44 through the output side gear 62, the input power can be output at a precise rotational ratio and 22 with reliability. Hence, the lower pressure-bearing member 23 can be moved with accuracy and, accordingly, the upper structure 1 can be lifted up to a precise position with respect to the lower structure 2. Shown in FIG. 7 is a characteristic of "input torque from shaft—output load by jack" showing the relation between the input torque from shaft (the torque input from the drive shaft 52) and the output load by jack (the load that can be lifted up by the upper pressure-bearing member 22) obtained when the driving device 24 of the illustrated embodiment is used. It will be understood in FIG. 7 that the output load by jack correlates with the input torque from shaft with a high degree of accuracy, so that when the driving device 24 of the illustrated embodiment is used, the lift-up load can be afforded with accuracy and reliability with reference to the rotation of the drive shaft 52.

Also, since the driving device 24 of the illustrated embodiment adopts the reduction gear mechanism 53, the possible damage that can be caused by using the hydraulic jack can be reduced, thus enabling the lower pressure-bearing member 23 to be always moved with accuracy. Besides, after the upper structure 1 is raised up to a suitable position with respect to the lower structure 2, the inventive supporting apparatus can be used as the supporting member 3 as it is, without any stop members being fitted. Thus, improved workability can be produced.

In addition, since the drive shaft 52 and the feed screw 44 are arranged on the same axis 66, improved capability of transmission and workability resulting from the size reduction of the reduction gear mechanism 53 are provided. Further, since the intermediate gear elements 64, 65 are so constructed that the first intermediate gears 69, 70 and the second intermediate gears 71, 72 are arranged on the concentric axes in such a manner as to be non-rotatable relative thereto and also the intermediate gear elements 64, 65 are arranged in parallel around the axis 66 on which the drive shaft 52 and the feed screw 44 are aligned, efficient power transmission resulting from further size reduction can be achieved.

In the illustrated embodiment, the sliding members and engaging members in the driving device 24, i.e., the output-side gear 63, the feed screw 44, the drive shaft 52 on which the input-side gear 63 is integrally formed, and the gear shafts 67, 68 on which the first intermediate gears 69, 70 and the second intermediate gears 71, 72 are integrally formed, are coated with nickel-phosphorus plating. The nickel-phosphorus plating is conducted by, for example, the step that the parts to be plated are immersed in plating solution containing nickel and phosphorus to be coated with 2–100 $\mu$m, preferably 5–50 $\mu$m, of plating layers by means of electroless plating and thereafter the coated parts are heat-treated at 300–1,000° C., preferably 300–400° C., for 1–3 hours, when necessary.

With this nickel-phosphorus plating, part-to-part variations in coefficient of friction can be reduced. Thus, the power input from the drive shaft 52 can be transmitted to the feed screw 44 with efficiency. Thus, the input power can be output at a more accurate rotational ratio and with further reliability. The phosphorus content in the coating of the electroless plating is preferably 1–15 weight %, for example.

In this nickel-phosphorus plating given to the parts of the illustrated embodiment, fluorine components including particles of fluorine-contained resin and particles of graphite fluoride, such as polytetrafluoroethylene, tetrafluoroethylene/hexafluoropropylene copolymerizate and tetrafluoroethylene/perfluoroalkyl vinyl ether copolymerizate, are further mixed in the plating solution containing nickel and phosphorus, and an electroless plating film in which fluorine components are eutectic dispersed in a matrix of nickel-phosphorus film is formed on the surfaces of the parts. The eutectoid of the fluorine components can provide improvements of parts in wear resistance, sliding resistance and quiet. This can permit the power input from the drive shaft 52 to be transmitted to the feed screw 44 with efficiency. Accordingly, the input power can be output at a more accurate rotational ratio and with further reliability. The fluorine components in the electroless plating film is considered to be preferably 1–40 weight percent of eutectoid, further preferably 2–10 weight percent of eutectoid, of the whole film. In this plating, hardening and tempering may be performed, when necessary. It is preferable that the plating is conducted so that the electroless plating film can have the hardness of 300–1,000, further preferably 400–800 in Vickers hardness.

Figure 8:
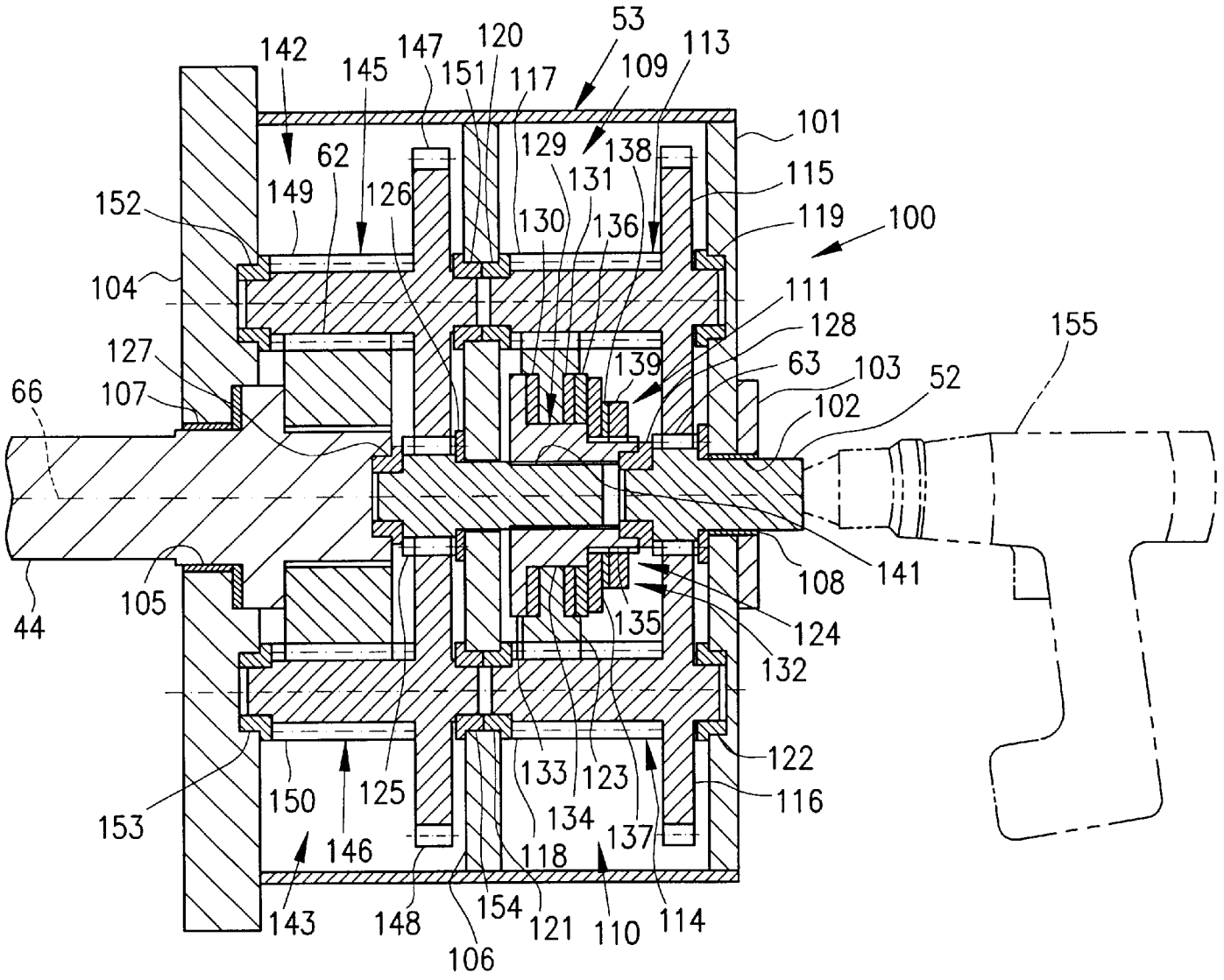
FIG. 8 is an upper sectional view showing an inside structure of a driving device of another embodiment different from the driving device of FIG. 2.

Shown in FIG. 8 is an upper sectional view showing an inside structure of a driving device 100 of another embodiment different from the above-illustrated driving device 24.

In FIG. 8, the driving device 100 is provided with the drive shaft 52, the retaining member 42 (not shown in FIG. 8) and the feed screw 44, as in the case of the above-illustrated driving device 24, but the reduction gear mechanism 53 and the gear box 50 housing it therein are different in structure from those of the above-illustrated driving device 24.

Specifically, the gear box 50 is a rectangular box made of iron and steel material and has, at a center part of the front wall 101, an aperture opening for the drive shaft 52 to pass through. Provided in the aperture is a ring-like drive shaft supporting member 103 having a front insertion hole 102 for the drive shaft 52 to be passed through and supported therein. The gear box 50 has, at a center part of the rear wall 104, a rear insertion hole 105 for the feed screw 44 to pass through. The front insertion hole 102 in the drive shaft supporting member 103 is axially aligned with the rear insertion hole 105 in the rear wall 104. The gear box 50 has, at a generally center part thereof between the front wall 101 and the rear wall 104, a holder plate 106, arranged in parallel with the front wall 101 and the rear wall 104, for holding gear shafts 113, 114, 145 and 146 as mentioned later. The gear box 50 is supported by four stay bolts not shown.

The feed screw 44 is supported in the rear wall 104 of the gear box 50 in a rotatable manner via a bearing metal 107, passing through the rear insertion hole 105. The drive shaft 52 is supported by the drive shaft supporting member 103 and the front wall 101 in a rotatable manner via a bearing metal 108, passing through the front insertion hole 102. Thus, the drive shaft 52 and the feed screw 44 are aligned with each other on the same axis. The axis is indicated by reference numeral 66 in FIG. 8.

The reduction gear mechanism 53 is provided with the input-side gear 63, the output-side gear 62, two input-side gear elements 109, 110, a transfer gear element 111 and two output-side gear elements 142, 143.

The two input-side gear elements 109, 110 are located near the drive shaft 52 and arranged in parallel with the axis 66 on which the drive shaft 52 and the feed screw 44 are aligned, with being shifted to each other at 180 degree across the axis 66. In other words, the reduction gear mechanism 53 is composed of two gear shafts 113, 114 arranged in parallel about the axis 66 and the first intermediate gears 115, 116 and the second intermediate gears 117, 118 which are formed on the two gear shafts 113, 114, respectively.

The two gear shafts 113, 114 are rotatably supported by the front wall 101 of the gear box 50 and the holder plate 106 via bearing metals 119, 120, and 121, 122. The first intermediate gears 115, 116 are integrally formed on the gear shafts 113, 114 at one side end portions thereof so that the centers of rotation can be formed by the axes of the gear shafts 113, 114 and are so arranged as to be engaged with the input-side gear 63. The second intermediate gears 117, 118, which are disposed adjoining to the first intermediate gears 115, 116 in the axial direction of the gear shafts 113, 114, are integrally formed with the gear shafts 113, 114 so that the centers of rotation can be formed by the axes of the gear shafts 113, 114 and are so arranged as to be engaged with the third intermediate gear 123 of the transfer gear element 111 as mentioned below. Thus, the first intermediate gears 115, 116 and the second intermediate gears 117, 118 are housed in the gear box 50 such as to be axially aligned with and non-rotatable relative to each other.

The transfer gear element 111 is composed of a transfer shaft 141 disposed between the drive shaft 52 and the feed screw 44 and arranged on the axis 66 on which the drive shaft 52 and the feed screw 44 are aligned and; an overload protection mechanism 124 arranged around the transfer shaft 141; a third intermediate gear 123 arranged around the overload protection mechanism 124; and a fourth intermediate gear 125 formed around the transfer shaft 141.

The transfer shaft 141 is rotatably supported on the holder plate 106 of the gear box 50 via the bearing metal 126. The transfer shaft 141 is formed to have a smaller diameter than the feed screw 44, so that its one side end portion is received in a recessed portion in the end of the feed screw 44 in such a manner as to be rotatable via the bearing metal 127 and its other side end portion is abutted to the drive shaft 52 in such a manner as to be rotatable via the bearing metal 128.

The overload protection mechanism 124 is provided with a hub member 129 arranged around the drive shaft 52, a first lining plate 130, a second lining plate 131 and a load setting mechanism 132 for setting a rated load. On the hub member 129 are integrally formed a flange portion 133; a large-diameter cylindrical portion 134 projecting from the flange portion 133 toward the front wall 101; and a small-diameter cylindrical portion 135 further projecting from the large-diameter cylindrical portion 134 toward the front wall 101 and formed to have a smaller diameter than the large-diameter cylindrical portion 134. The hub member 129 is splined to the transfer shaft 141 in such a manner as to be non-rotatable relative thereto and axially movable. The small-diameter cylindrical portion 135 has, at an end portion thereof, a recessed portion, in which the bearing metal 128 interposed between the small-diameter cylindrical portion 135 and the drive shaft 54 is received to hold the hub member 129 on the drive shaft 54 via the bearing metal 128. A female thread is formed around the outer surface of the small-diameter cylindrical portion 135.

The third intermediate gear 123, the first lining plate 130 and the second lining plate 131 are rotatably supported on the large-diameter cylindrical portion 134 of the hub member 129, with the third intermediate gear 123 held between the first lining plate 130 and the second lining plate 131.

The load setting mechanism 132 is composed of a lining keep plate 136; a belleville spring 137; a locking member 138; and a tightening nut 139. The lining keep plate 136 is rotatably supported on the small-diameter cylindrical portion 135 of the hub member 129 in the state of abutting with the first lining plate 130. For biasing the lining keep plate 136 toward the first lining plate 130, the belleville spring 137 is supported on the small-diameter cylindrical portion 135 of the hub member 129 in the state of abutting with the lining keep plate 136. For adjusting the biasing force of the belleville spring 137, the tightening nut 139 is threadedly engaged with the small-diameter cylindrical portion 135 of the hub member 129 such that the belleville spring 137 can be pressed through the locking member 138.

Thus, when the tightening nut 139 is screwed forward along the small-diameter cylindrical portion 135 of the hub member 129, the belleville spring 137 strongly presses the first lining plate 130, the third intermediate gear 123 and the second lining plate 131 through the lining keep plate 136. As a result of this, the third intermediate gear 123 is pressed by the first lining plate 130 and the second lining plate 131 and, accordingly, even when an increased load is applied on the feed screw 44 side, the third intermediate gear 123 can be prevented from being slipped against the first lining plate 130 and the second lining plate 131 to avoid interruption of the transmission of power between the drive shaft 54 and the feed screw 44, thus permitting a rated load to be set high.

On the other hand, as the tightening nut 139 is screwed backward along the small-diameter cylindrical portion 135 of the hub member 129, the pressing force to the first lining plate 130, the third intermediate gear 123 and the second lining plate 131 between the tightening nut 139 and the flange portion 133 of the hub member 129 is reduced. When an increased load is applied on the feed screw 44 side, the third intermediate gear 123 is slipped against the first lining plate 130 and the second lining plate 131 to interrupt the transmission of power between the drive shaft 54 and the feed screw 44, thus permitting a rated load to be set low.

The fourth intermediate gear 125, which adjoins the overload protection mechanism 124 across the holder plate 106 in the axial direction of the transfer shaft 141, is integrally formed on the transfer shaft 141 so that the center of rotation can be formed by the axis of the transfer shaft 141 and is so arranged as to be engaged with fifth intermediate gears 147, 148 of the output-side gear elements 142, 143.

The two output-side gear elements 142, 143 are located near the feed screw 44 and arranged in parallel with the axis 66 on which the drive shaft 52 and the feed screw 44 are aligned, with being shifted to each other at 180 degree across the axis 66. In other words, the output-side gear elements 142, 143 are composed of two gear shafts 145, 146 arranged in parallel about the axis 66; and the fifth intermediate gears 147, 148 and the sixth intermediate gears 149, 150 which are formed on the two gear shafts 145, 146, respectively.

The two gear shafts 145, 146 are rotatably supported by the rear wall 104 of the gear box 50 and the holder plate 106 via bearing metals 151, 152, and 153, 154, respectively. The fifth intermediate gears 147, 148 are integrally formed on the gear shafts 145, 146 at one side end portions thereof such that the centers of rotation can be formed by the axes of the gear shafts 145, 146 and are so arranged as to be engaged with the fourth intermediate gear 125. The sixth intermediate gears 149, 150, which are disposed adjoining to the fifth intermediate gears 147, 148 in the axial direction of the gear shafts 145, 146, are integrally formed on the gear shafts 145, 146 so that the centers of rotation can be formed by the axes of the gear shafts 145, 146 and are so arranged as to be engaged with the output-side gear 62. Thus, the fifth intermediate gears 147, 148 and the sixth intermediate gears 149, 150 are housed in the gear box 50 such as to be axially aligned with and non-rotatable relative to each other.

To raise the upper structure 1 up to a suitable position with respect to the lower structure 2 by the driving device 100 thus constructed, turning of the drive shaft 52 is required, as is the case of the above. The power input from the drive shaft 52 is then transmitted through the input-side gear 63 to the two intermediate gear elements 109, 110 located near the drive shaft 52 and arranged in parallel around the axis 66 on which the drive shaft 52 and the feed screw 44 are aligned. In the input-side gear elements 109, 110, the power is transmitted to the second intermediate gears 117, 118 from the first intermediate gears 115, 116 which are located on the axes of the gear shafts 113, 114 in such a manner as to be non-rotatable relative thereto. After that, the power is transmitted from the second intermediate gears 117, 118 of the input-side gear elements 109, 110 to the third intermediate gear 123 of the transfer gear element 111.

Then, the power transmitted to the third intermediate gear 123 of the transfer gear element 111 is transmitted from the third intermediate gear 123 to the fourth intermediate gear 125, when the load is not in excess of the preset load of the overload protection mechanism 124, such that the third intermediate gear 123 pressed and held by the first lining plate 130 and the second lining plate 131 is allowed to rotate together with the hub member 129, the transfer shaft 141 splined to the hub member 129, and the fourth intermediate gear 125 integrally formed on the transfer shaft 141. After that, the power is transmitted from the fourth intermediate gear 125 of the transfer gear element 111 to the fifth intermediate gears 147, 148 of the two output-side gear elements 142, 143 located near the feed screw 44 and arranged in parallel around the axis 66 on which the drive shaft 52 and the feed screw 44 are aligned.

If the load is in excess of the preset load of the overload protection mechanism 124, then the third intermediate gear 123 is slid against the first lining plate 130 and the second lining plate 131, as aforementioned, so that the power is not transmitted from the third intermediate gear 123 to the fourth intermediate gear 125. Thus, when a load in excess of a rated load is applied, the transmission path of the reduction gear mechanism 53 is interrupted by the overload protection mechanism 124, so that damage of the apparatus due to the overload can be prevented and also can ensure the safety in working.

Then, the power transmitted to the fifth intermediate gears 147, 148 of the two output-side gear elements 142, 143 is transmitted to the sixth intermediate gears 149, 150 from the fifth intermediate gears 147, 148 which are arranged on the axes of the gear shafts 145, 146 in such a manner as to be non-rotatable thereto in the output-side gear elements 142, 143, respectively. Then, the power is transmitted from the sixth intermediate gears 149, 150 of the output-side gear elements 142, 143 to the feed screw 44 through the output-side gear element 62.

Then, in the illustrated driving device 100, since the power input from the single drive shaft 52 is transmitted the two input-side gear elements 109, 110 through the input-side gear 63 and then to the two output-side gear elements 142, 143 through the transfer gear element 111 having the overload protection mechanism 124 and further to the single feed screw 44 through the output-side gear 62, the input power can be output at an accurate rotational ratio and with reliability. Besides, since the reduction gear mechanism 53 is designed to have more stages than the aforementioned driving device 24, even when the torque of the drive shaft 52 is small, an increased output load can be output from the feed screw 44.

Figure 9:
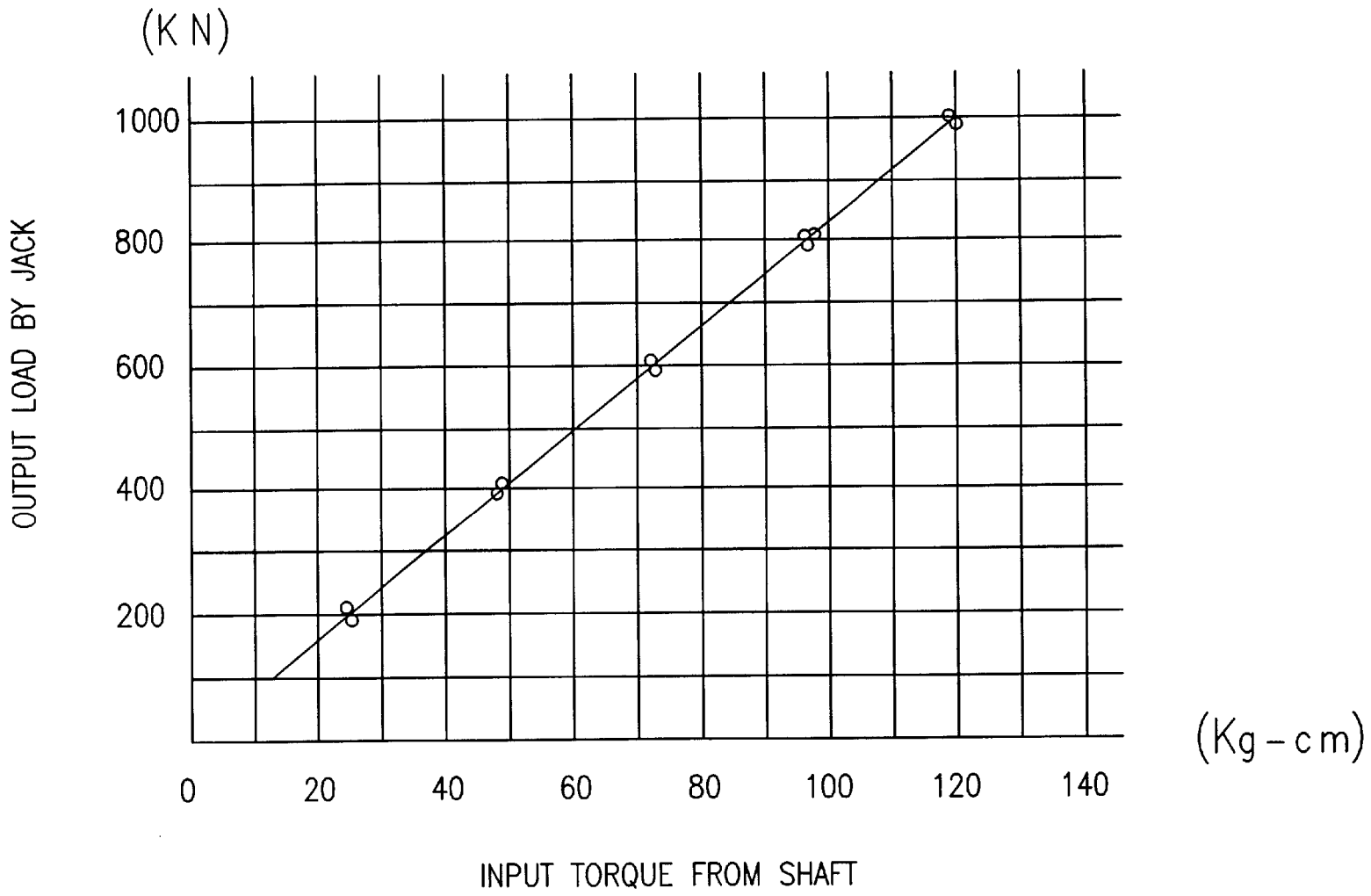
FIG. 9 is a diagram showing a characteristic of "Input Torque From Shaft—Output Load By Jack" of the supporting apparatus having the driving device of FIG. 8.
Figure 10:
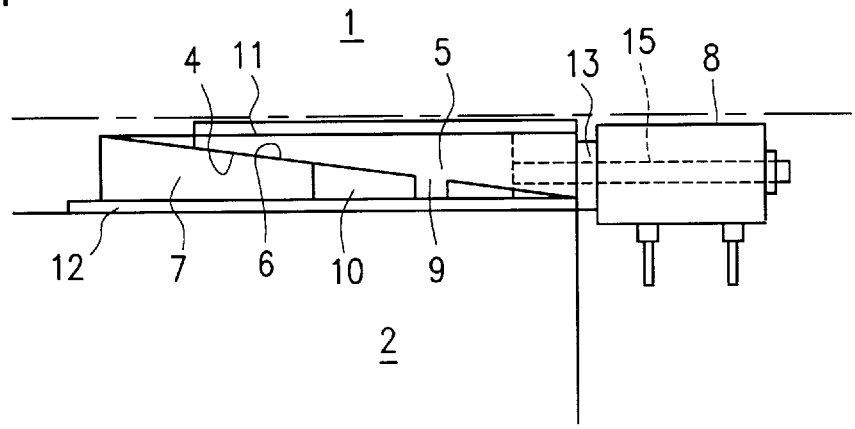
FIG. 10 PRIOR ART
FIG. 10 is a side elevation view of a conventional type of supporting apparatus which is in the state of use.
Figure 11:
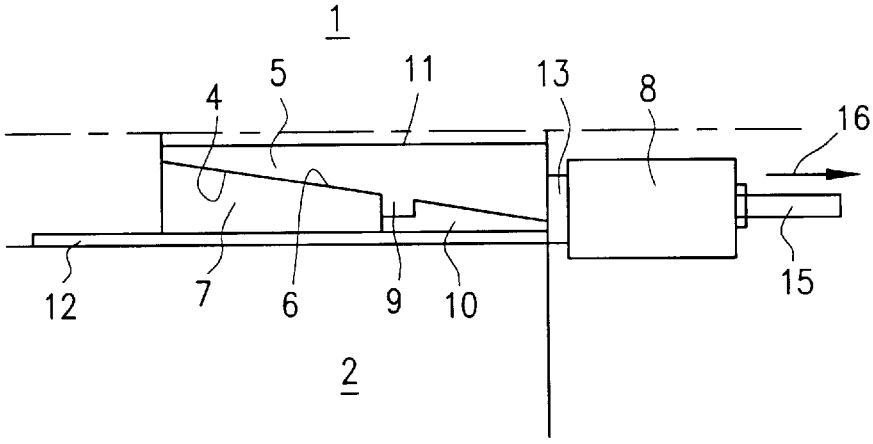
FIG. 11 PRIOR ART
FIG. 11 is a side elevation view of the conventional type of supporting apparatus which is in the state of use.
Figure 12:
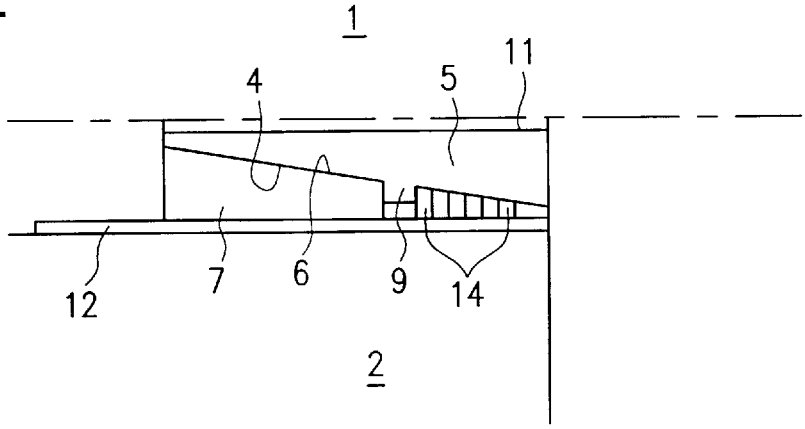
FIG. 12 PRIOR ART
FIG. 12 is a side elevation view of the conventional type of supporting apparatus which is in the state of use.

Shown in FIG. 9 is a characteristic of "input torque from shaft—output load by jack" showing the relation between the input torque from shaft (the torque input from the drive shaft 52) and the output load by jack (the load that can be lifted up by the upper pressure-bearing member 22) obtained when the driving device 100 of the illustrated embodiment is used. It will be understood in FIG. 9 that the output load by jack correlates with the input torque from shaft with a high degree of accuracy, so that, when the driving device 100 of the illustrated embodiment is used, the lift-up load can be afforded with accuracy and reliability with reference to the rotation of the drive shaft 52 and also even when the torque of the drive shaft 52 is small, an increased output load can be output from the feed screw 44. Accordingly, the upper structure 1 can be lifted up with respect to the lower structure 2 readily and quickly by using a tool of small torque like an electric driver 155, as indicated by a phantom line in FIG. 8, for example.

Also, since the diving device 100 of the illustrated embodiment has the go features that the drive shaft 52, the transfer gear element 111 and the feed screw 44 are aligned on the same axis 66; that the two input-side gear elements 109, 110 are arranged in parallel around the axis 66 of the drive shaft 52 and feed screw 44, such that the first intermediate gears 115, 116 and the second intermediate gears 117, 118 are arranged on the concentric axes in such a manner as to be non-rotatable relative thereto; and that the two output-side gear elements 142, 143 are arranged in parallel around the axis 66 of the drive shaft 52 and feed screw 44, such that the fifth intermediate gears 147, 148 and the sixth intermediate gears 149, 150 are arranged on the concentric axes in such a manner as to be non-rotatable relative thereto, a further improved efficiency in the power transmission originating from the further size reduction can be achieved.

For permitting the connection of the electric driver 155 to the drive shaft 52, as mentioned above, for example a fitting portion fittingly engageable with a drive shaft of the electric driver 155 may be provided in the drive shaft 52 to permit the direct connection or a coupling may be interposed therebetween to permit the indirect connection.

To prevent reverse rotation of the feed screw 44 during the drive of the driving device 100, in other words, to prevent height reduction of the upper structure 1, the overload protection mechanism 124 may be provided with an one-way mechanism.

In the driving device 100 of the illustrated embodiment as well, as is the case with the aforementioned driving device 24, the sliding members and engaging members, i.e., the output-side gear 63, the feed screw 44, the drive shaft 52 on which the input-side gear 63 is integrally formed, the gear shafts 113, 114 on which the first intermediate gears 115, 116 and the second intermediate gears 117, 118 are integrally formed, the third intermediate shaft 123, the transfer shaft 141 on which the fourth intermediate shaft 125 is integrally formed, and the gear shafts 145, 146 on which the fifth intermediate gears 147, 148 and the sixth intermediate gears 149, 150 are integrally formed may be plated with nickel-phosphorus or with the components in which fluorine components are further mixed in the nickel-phosphorus.

According to the present invention, no particular limitation is imposed on the number of gears of the reduction gear mechanism. For example, a single gear may be used for the intermediate gear element, but five or more gears are of preferable though it may be properly selected in accordance with the purpose and the use. As for the rotational ratio between the input shaft and the output shaft, a desired gear ratio may be suitably selected in accordance with the purpose and the use. Further, a planetary gear mechanism may be adopted as the gear transmission mechanism.

While the structure supporting apparatus of the illustrated embodiments is used in such as manner as to be interposed between the upper structure 1 and the lower structure 2, it may be used in such a manner as to be interposed between a right-side structure and a left-side structure. Also, the structure supporting apparatus may be simply used as a jack, rather than the supporting member 3. While the driving device 24 or the driving device 100 is mounted on the lower pressure-bearing member 23 in the illustrated embodiments, it may be mounted on the upper pressure-bearing member 22 or on both of the upper pressure-bearing member 22 and the lower pressure-bearing member 23.

While the illustrative embodiment of the present invention is provided in the above description, such is for illustrative purpose only and it is not to be construed restrictively. Modification and variation of the present invention that will be obvious to those skilled in the art is to be covered in the accompanying claims.

What is claimed is:

1. A structure supporting apparatus which comprises a first pressure-bearing member having a first sliding surface of a slant surface, a second pressure-bearing member laid on the first pressure-bearing member and having a second sliding surface of a slant surface slidably engaged with the first sliding surface, and a driving means for moving at least one of the first pressure-bearing member and the second pressure-bearing member and is so structured that the first sliding surface and the second sliding surface can be slid over each other by drive of said driving means, while the first pressure-bearing member and the second pressure-bearing member are moved relative to each other, whereby the thickness of the first pressure-bearing member and the second pressure-bearing member in an overlaying direction thereof can be varied, characterized in:

that said driving means includes an input shaft to which power from a power source is input, an output shaft mounted on said at least one of the first pressure-bearing member and the second pressure-bearing member, said input shaft and said output shaft being aligned on the same axis, and a gear transmission mechanism that receives the power input from said input shaft to transmit it to said output shaft at a predetermined rotational ratio;

that said gear transmission mechanism includes an input-side gear provided on said input shaft, an output-side gear provided on said output shaft, and intermediate gear elements including intermediate gears engageable with at least said input-side gear and said output-side gear; and that said intermediate gear elements are provided between said input-side gear and said output-side gear and arranged in parallel around the axis on which said input shaft and said output shaft are aligned, and said intermediate gear elements are each composed of a first intermediate gear engageable with said input-side gear and a second intermediate gear engageable with said output-side gear, and said first intermediate gear and said second intermediate gear are aligned on the same axis in such a manner as to be non-rotatable thereto.

2. A structure supporting apparatus which comprises a first pressure-bearing member having a first sliding surface of a slant surface, a second pressure-bearing member laid on the first pressure-bearing member and having a second sliding surface of a slant surface slidably engaged with the first sliding surface, and a driving means for moving at least one of the first pressure-bearing member and the second pressure-bearing member and is so structured that the first sliding surface and the second sliding surface can be slid over each other by drive of said driving means, while the first pressure-bearing member and the second pressure-bearing member are moved relative to each other, whereby the thickness of the first pressure-bearing member and the second pressure-bearing member in an overlaying direction thereof can be varied, characterized in:

that said driving means includes an input shaft to which power from a power source is input, an output shaft mounted on said at least one of the first pressure-bearing member and the second pressure-bearing member, said input shaft and said output shaft being aligned on the same axis, and a gear transmission mechanism that receives the power input from said input shaft to transmit it to said output shaft at a predetermined rotational ratio;

that said gear transmission mechanism includes an input-side gear provided on said input shaft, an output-side gear provided on said output shaft, and intermediate gear elements including intermediate gears engageable with at least said input-side gear and said output-side gear; and wherein said intermediate gear elements are provided between said input-side gear and said output-side gear and include input-side gear elements located near said input shaft and arranged in parallel around said axis on which said input shaft and said output shaft are aligned, a transfer gear element disposed between said input shaft and said output shaft and arranged on the axis on which said input shaft and said output shaft are aligned, and output-side gear elements located near said output shaft and arranged in parallel around the axis on which said input shaft and said output shaft are aligned;

wherein said input-side gear elements include a first intermediate gear engageable with said input-side gear and a second intermediate gear engageable with said transfer gear element;

wherein said transfer gear element includes a third intermediate gear engageable with the second intermediate gear and a fourth intermediate gear engageable with said output-side gear element;

wherein said out-put side gear elements include a fifth intermediate gear engageable with the fourth intermediate gear and a sixth intermediate gear engageable with said output-side gear; and wherein the first intermediate gear, the second intermediate gear, the fifth intermediate gear, and the sixth intermediate gear are aligned on concentric axes; the first intermediate gear and the second intermediate gear are arranged in such a manner as to be non-rotatable relative to each other; and the fifth intermediate gear and the sixth intermediate gear are arranged in such a manner as to be non-rotatable relative to each other.

3. A structure supporting apparatus which comprises a first pressure-bearing member having a first sliding surface of a slant surface, a second pressure-bearing member laid on the first pressure-bearing member and having a second sliding surface of a slant surface slidably engaged with the first sliding surface, and a driving means for moving at least one of the first pressure-bearing member and the second pressure-bearing member and is so structured that the first sliding surface and the second sliding surface can be slid over each other by drive of said driving means, while the first pressure-bearing member and the second pressure-bearing member are moved relative to each other, whereby the thickness of the first pressure-bearing member and the second pressure-bearing member in an overlaying direction thereof can be varied, characterized in:

that said driving means includes an input shaft to which power from a power source is input, and output shaft mounted on said at least one of the first pressure-bearing member and the second pressure-bearing member, and a gear transmission mechanism that receives the power input from said input shaft to transmit it to said output shaft at a predetermined rotational ratio;

that said gear transmission mechanism includes an input-side gear provided on said input shaft, and output-side gear provided on said output shaft, and intermediate gear elements including intermediate gears engageable with at least said input-side gear and said output-side gear; said intermediate gear elements being provided between said input-side gear and said output-side gear, and an overload protection mechanism interposed in a transmission path of said gear transmission mechanism, for interrupting the transmission path when a load in excess of a rated load is applied.

4. A structure supporting apparatus according to claim 1, wherein at least the components of said gear transmission mechanism consisting of said input-side gear, said output-side gear and gears included in said intermediate gear elements are coated with nickel-phosphorus plating.

5. A structure supporting apparatus according to claim 4, wherein fluorine components are mixed in the nickel-phosphorus plating, and a plating film in which fluorine components are eutectic dispersed in a matrix of nickel-phosphorus film is formed on the surfaces of the components.

* * * * *